US011937635B2

(12) United States Patent
Zhao et al.

(10) Patent No.: US 11,937,635 B2
(45) Date of Patent: Mar. 26, 2024

(54) ATOMIZER HAVING DETACHABLE ATOMIZING CORE AND ELECTRONIC CIGARETTE

(71) Applicant: SHENZHEN FIRST UNION TECHNOLOGY CO., LTD., Shenzhen (CN)

(72) Inventors: Xiaoqiang Zhao, Shenzhen (CN); Gaofeng Yan, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 526 days.

(21) Appl. No.: 17/290,299

(22) PCT Filed: Oct. 30, 2019

(86) PCT No.: PCT/CN2019/114420
§ 371 (c)(1),
(2) Date: Apr. 30, 2021

(87) PCT Pub. No.: WO2020/088539
PCT Pub. Date: May 7, 2020

(65) Prior Publication Data

US 2022/0015422 A1 Jan. 20, 2022

(30) Foreign Application Priority Data

Nov. 2, 2018 (CN) ..... 201811299420.9

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/44* (2020.01); *A24F 40/46* (2020.01)

(58) Field of Classification Search
CPC ..... A24F 40/42; A24F 40/10; A24F 40/46; A24F 40/44
(Continued)

(56) References Cited

U.S. PATENT DOCUMENTS 4,676,408 A * 6/1987 Speitel ..... B65D 83/384 222/183
11,785,988 B2 * 10/2023 Lukan ..... A24F 40/60 131/329
(Continued)

FOREIGN PATENT DOCUMENTS

CN 205321203 U 6/2016
CN 205321209 U 6/2016
(Continued)

*Primary Examiner* — Gary F Paumen
(74) *Attorney, Agent, or Firm* — PROI Intellectual Property US; Klaus Michael Schmid

(57) ABSTRACT

The base is provided with a first sliding position and a second sliding position along the sliding direction of the latch; when the sliding latch is in the first sliding position, it is connected to the atomization core to restrict the axial movement of the atomization core along the through-hole; and when it is in the second sliding position, it is disengaged from the atomization core to release the restriction. The detachable atomization core atomizer of the present invention is designed by the way of lower intake and lower replacement of atomization core; by sliding the latch, the atomization core is automatically ejected; when installing the atomization core, just insert it according to the direction, simple and hygienic operation without oil leakage.

13 Claims, 10 Drawing Sheets

(51) Int. Cl.
*A24F 40/44* (2020.01)
*A24F 40/46* (2020.01)

(58) Field of Classification Search
USPC ..... 131/329
See application file for complete search history.

(56) References Cited

U.S. PATENT DOCUMENTS

| | | | | |
|---|---|---|---|---|
| 2016/0050975 | A1 | 2/2016 | Worm et al. | |
| 2016/0353798 | A1 | 12/2016 | Liu | |
| 2017/0071260 | A1* | 3/2017 | Li | A24F 40/42 |
| 2017/0172207 | A1 | 6/2017 | Liu | |
| 2018/0049470 | A1 | 2/2018 | Chen | |
| 2018/0084832 | A1* | 3/2018 | Li | B05B 12/081 |
| 2018/0116295 | A1* | 5/2018 | Qiu | B65D 50/062 |
| 2018/0255836 | A1* | 9/2018 | Qiu | A24F 40/485 |
| 2019/0075846 | A1* | 3/2019 | Qiu | A24F 40/49 |
| 2019/0098931 | A1* | 4/2019 | Leadley | A61M 15/06 |
| 2019/0239565 | A1* | 8/2019 | Qiu | H01H 9/22 |

FOREIGN PATENT DOCUMENTS

| | | | |
|---|---|---|---|
| CN | 205794808 | U | 12/2016 |
| CN | 205962831 | U | 2/2017 |
| CN | 206453250 | U | 9/2017 |
| CN | 206565292 | U | 10/2017 |
| CN | 108634385 | A | 10/2018 |
| CN | 208002103 | U | 10/2018 |
| CN | 109303355 | A | 2/2019 |
| CN | 209376683 | U | 9/2019 |
| WO | 2016029344 | A | 9/2020 |

* cited by examiner

ATOMIZER HAVING DETACHABLE ATOMIZING CORE AND ELECTRONIC CIGARETTE

The present application claims priority to Chinese Patent Application No. 201811299420.9, filed on Nov. 2, 2018 in China National Intellectual Property Administration and entitled "Atomizer with Detachable Atomizer Core and Electronic Cigarette", which is hereby incorporated by reference in its entirety.

TECHNICAL FIELD

The present disclosure relates to the technical field of atomizers of electronic cigarettes, and particularly relates to an atomizer with a detachable atomizer core, and an electronic cigarette.

BACKGROUND

A core component of an electronic cigarette product is the atomizer, and a key functional part of the atomizer is an atomizer core. The atomizer core usually includes a porous body that conducts smoking oil, and a heating part. The smoking oil is atomized by heating of the heating element. The atomizer core is a component of the electronic cigarette that is shortest in life and most easily damaged. For maximum utilization of resources, only the atomizer core is replaced when other components are perfect, so that the product can continue to be used.

For a detachable and replaceable atomizer core of a current electronic flat cigarette, there are usually two corresponding structural designs for replacement. One design is to use an up core replacement structure. The atomizer core is lengthened and is assembled by threaded connection. After assembling, the whole atomizer core is soaked in smoking oil. During replacement, a mouth piece is opened from the top, and the atomizer core is removed from an atomizer sleeve for replacement. In this method, the atomizer core is taken out of the smoking oil for soaking, which easily brings out carrying smoking oil. Therefore, another bottom core replacement structural design is often used to replace the atomizer core. Specifically, for example, Heyuan Technology proposes a structural design for bottom core replacement provided in the patent of an atomizer with a replaceable atomizer core No. 201720131352.X. Specifically, an atomizer core is mounted on a first connection seat of a bearing structural component in an atomizer sleeve, and the first connecting seat itself is connected with the atomizer sleeve in a rotating manner; then, a second connecting seat that can rotate relative to the first connecting seat drives the first connecting seat to rotate, thereby removing the first connecting seat and the atomizer core from the bottom of the atomizer sleeve in a turning manner.

However, by the use of the above two rotating parts, i.e., the first connecting seat and the second connecting seat, during assembling of accessories that are connected in a relatively rotatable manner, on the one hand, the rotating structure and the assembling method are more complicated, and on the other hand, an oil storage chamber will be opened during various actions that cause rotation, so that the oil storage chamber cannot be closed and leaks the smoking oil; and after the replacement, the above rotating structure needs to be reassembled, which makes the operation more complicated.

SUMMARY

The technical problems to be solved by the present disclosure are to overcome the defects in the prior art, and an atomizer with a detachable atomizer core, in which the atomizer core is opened by means of a sliding latch for replacement and the operation is simple and convenient.

In order to solve the above-mentioned technical problems, the technical solution adopted by the present invention is as follows: an atomizer with a detachable atomizer core provided by the present disclosure includes a hollow atomizer sleeve with an open end, the atomizer sleeve including an oil storage chamber for storing smoking oil, and the atomizer core for atomizing the smoking oil; the atomizer further includes a base arranged at the open end of the atomizer sleeve; the base is provided with a through-hole for the atomizer core to penetrate to insert inside the atomizer sleeve, and a sliding latch slidingly connected to the base.

The base is further provided with a first sliding position and a second sliding position along the sliding direction of the sliding latch, wherein the sliding latch is configured such that when the sliding latch is in the first sliding position, the sliding latch is connected to the atomizer core to restrict axial movement of the atomizer core along the through-hole;

when the sliding latch is in the second sliding position, the sliding latch and the atomizer core are disengaged from each other to release the restriction.

Preferably, a sliding damping member is provided between the sliding latch and the base for providing damping during the sliding of the sliding latch.

Preferably, the sliding damping member is a first linear spring provided along the sliding direction of the sliding latch; the first linear spring is connected to the sliding latch at one end and to the base at the other end.

Preferably, the sliding damping member includes:

a first magnetic body provided on the sliding latch;

a second magnetic body provided on the base for attracting the first magnetic body when the sliding latch is in the first sliding position; and a third magnetic body either provided on the sliding latch for attracting the second magnetic body when the sliding latch is in a second sliding position, or provided on the base for attracting the first magnetic body when the sliding latch is in a second sliding position.

Preferably, the sliding latch includes a sliding portion for effecting a sliding connection with the base, and a snap-in portion for effecting a snap-in connection with the atomizer core;

the atomizer core is provided with a snap-in opening adapted to the snap-in portion; and when the sliding latch is in the first sliding position, the sliding latch is fixedly connected to the atomizer core in a snap-in manner by means of the snap-in portion and the snap-in opening.

Preferably, the snap-in portion is provided with a guiding slope on a surface opposite to the atomizer core; the guiding slope is provided in the direction of the sliding snap of the sliding latch, and in the direction of the atomizer sleeve at an angle.

Preferably, the base is provided with a guiding groove arranged along the sliding direction of the sliding latch, and the sliding portion is slidably arranged in the guiding groove.

Preferably, the sliding portion has an anti-slip rough surface exposed outside the base.

Preferably, the atomizer sleeve is further provided with a driving member for driving the atomizer core through the through hole to the outside.

Preferably, the driving member is a second linear spring provided in the direction of the atomizer core through the through hole; the second linear spring is connected to the inner wall of the atomizer sleeve at one end and to the atomizer core at the other end.

Preferably, a first sealing member is provided between the base and the oil storage chamber;

and/or, a second sealing member is provided between the atomizer core and the base.

Preferably, the base is further provided with a magnetic connector.

The present invention further provides an electronic cigarette, including an atomization device and a power supply device axially assembled with each other, the power supply device including a battery for supplying power to the atomization device; and the atomization device is the atomizer with the detachable atomizer core.

By the adoption of the above atomizer with the detachable atomizer core of the present invention, by means of the design of down air intake and down replacement of the atomizer core, during replacement of the atomizer core, the smoking oil cannot flow out, and the atomizer core can automatically pop out through sliding of the sliding latch; during mounting of the atomizer core, the atomizer core is plugged according to the direction, so that the operation is simple; and the atomizer is sanitary and free of oil leakage.

DETAILED DESCRIPTION

The structure of the foregoing atomizer with the detachable atomizer core and its convenient assembling and disassembling principle will be further described below with specific embodiments. The atomizer with a detachable atomizer core disclosed in the present disclosure is mainly suitable for electronic cigarette products. Of course, it can also be used in liquid drug composition volatilization devices or other aromatic composition releasing devices based on the same atomization function. In the following embodiments of the present disclosure, an electronic flat cigarette product is taken as an example for description. The appearance shape is the shape of a flat cigarette, but it is not limited to this specific situation, and technical personnel can make changes based on this shape during implementation.

An atomizer with a detachable atomizer core is implemented by means of down core replacement, and is structurally composed of an atomizer sleeve, an atomizer core provided in the atomizer sleeve, and a movable fixed supporting structure, mainly based on the overall design and an assembling connection method. A specific detailed structural design and a connection method for an electronic flat cigarette can refer to the accompanying drawings and the following descriptions.

Figure 1:
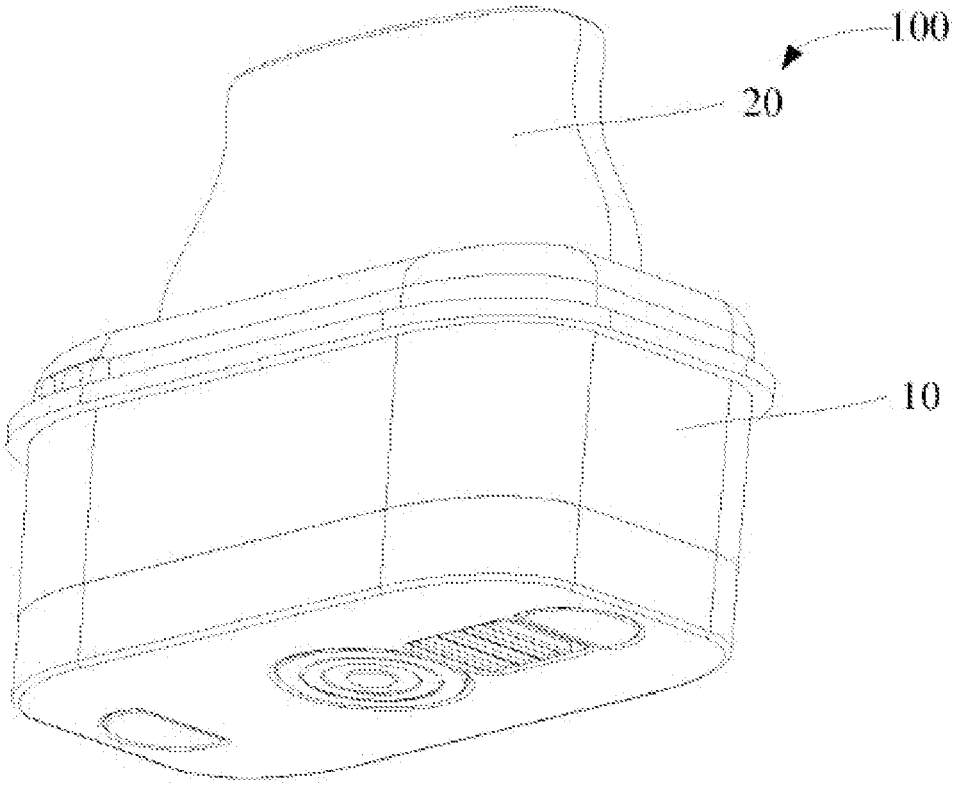
FIG. 1 is a schematic structural diagram of an atomizer with a detachable atomizer core provided in the embodiments after assembling.
Figure 2:
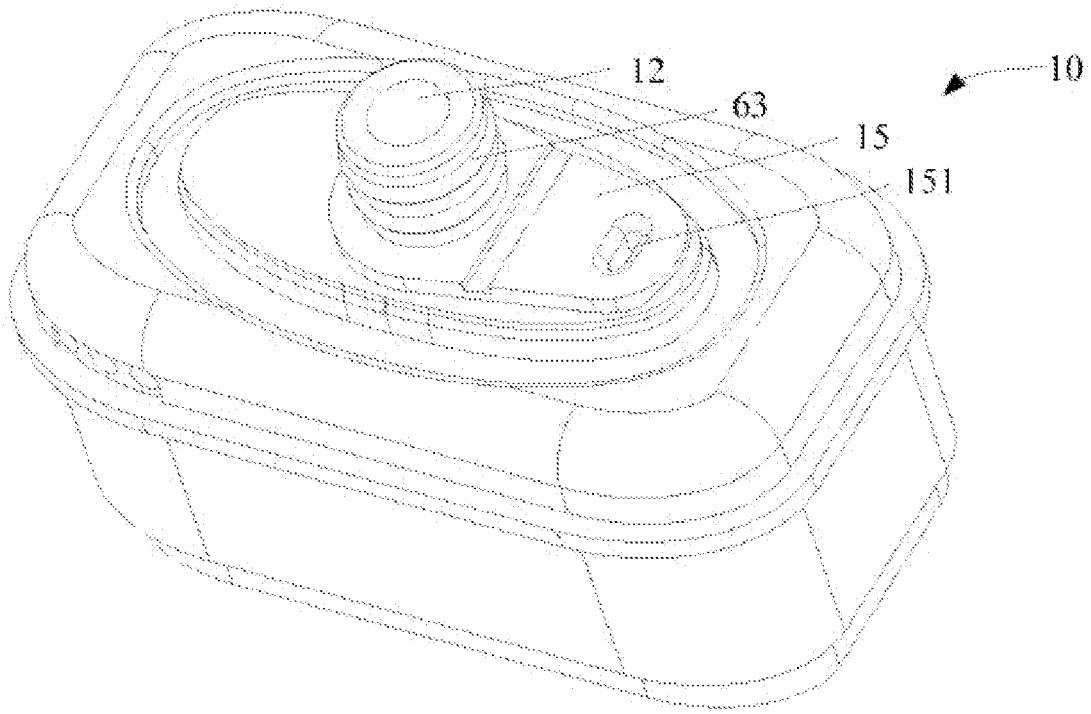
FIG. 2 is a schematic structural diagram of an atomizer sleeve in the embodiment of FIG. 1 from one visual angle.
Figure 3:
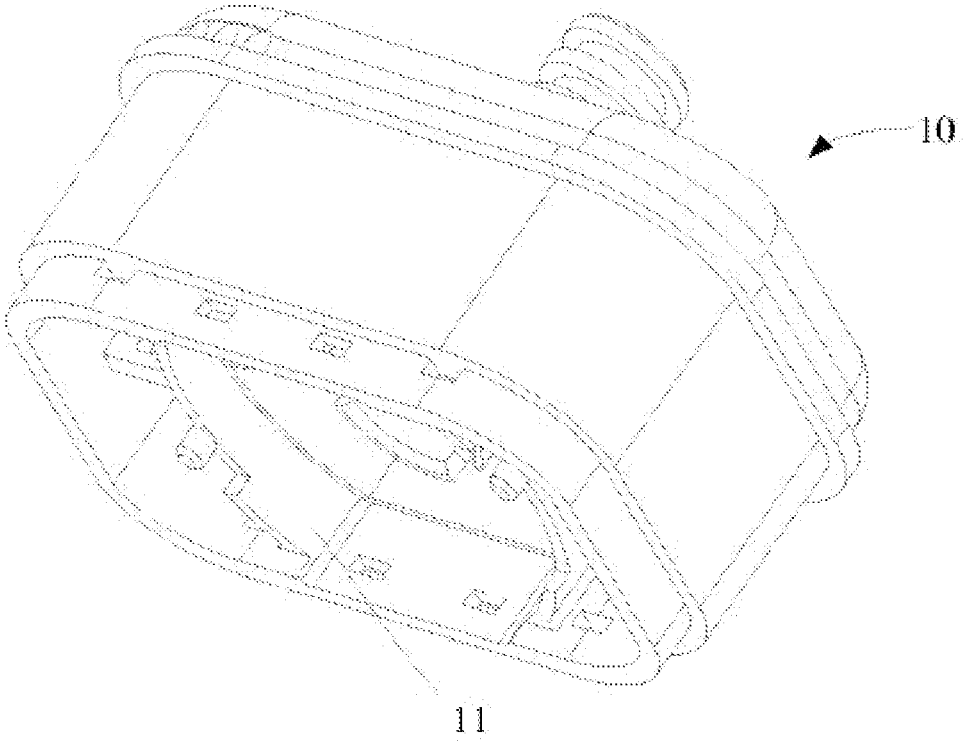
FIG. 3 is a schematic structural diagram of an atomizer sleeve involved in the embodiment of FIG. 1 from another visual angle.

Referring to FIG. 1 to FIG. 3 first, FIG. 1 is a schematic structural diagram of an atomizer100 with a detachable atomizer core shown in one embodiment of the present disclosure. According to the product diagram, FIG. 1 shows an overall appearance after combination and assembling. The outermost layer of component shown includes a columnar hollow atomizer sleeve 10, and a mouth piece cap 20 mounted on the atomizer sleeve 10 along an axial direction. An atomizer assembly for atomizing smoking oil is mounted in the atomizer sleeve 10. The smoking oil is output from the mouth piece cap 20 for smoking by a smoker after being atomized.

In the embodiment, the structure of the atomizer sleeve 10 refers to what is shown in FIG. 2 and FIG. 3. FIG. 2 and FIG. 3 are respectively schematic structural diagrams of the atomizer sleeve 10 in the embodiment at two visual angles. The head and tail ends of the atomizer sleeve 10 are respectively provided with air inlets 11 (in the figure, the lower end is opened) and an air outlet 12. Cyclic air flow circulation is formed inside the atomizer in combination with the hollow structure inside the atomizer sleeve 10. The air inlet 11 (used for inputting air into the atomizer) can directly or indirectly communicate with external atmosphere, and the air outlet 12 (used for outputting smoking oil aerosol from the atomizer) can also directly or indirectly communicate with the mouth piece cap 20 of the electronic cigarette, so that a customer can smoke the smoking oil aerosol formed in the atomizer through an air flow generated by the mouth piece cap 20. It can be seen from FIG. 3 that an opening in the lower end of the atomizer sleeve 10 is used as the air inlet 11 used in this embodiment; and furthermore, the space in this opening can also be used to accommodate internal various components and assemble other assemblies (such as a battery pack) of the electronic cigarette. In other variant embodiments or other variant structures, a suitable air inlet hole may also be independently formed, without using the opening in the lower end in the embodiment. The atomizer sleeve 10 is similar to a hollow cylindrical structure. The atomizer sleeve 10 also selects a matching appearance shape with reference to the flat cigarette according to the flatly cylindrical characteristics of the electronic flat cigarette product.

Figure 4:
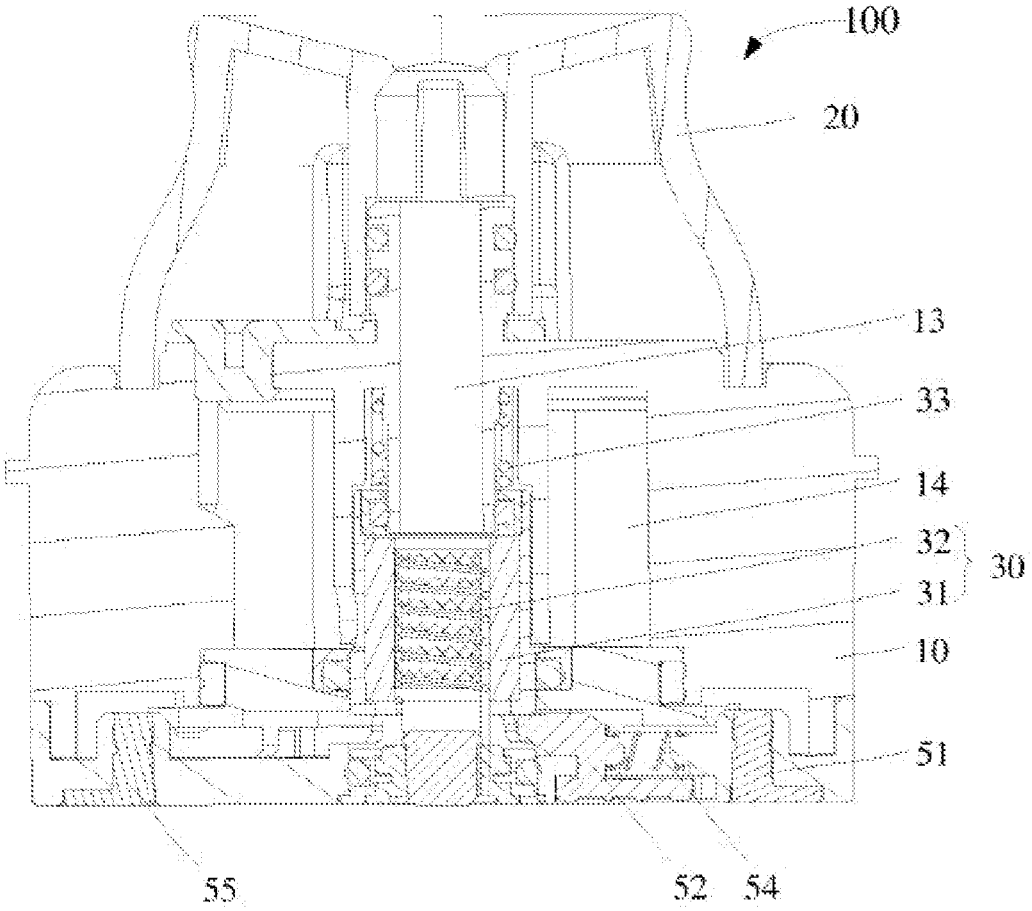
FIG. 4 is a schematic structural diagram of an axial section of an atomizer with a detachable atomizer core provided in the embodiments after assembling.

Further referring to FIG. 4, FIG. 4 is a schematic structural diagram of an axial section of the atomizer 100 with a detachable atomizer core provided in the above embodiment after assembling. It can be seen from FIG. 4 that a smoke passage 13 is provided in the atomizer sleeve 10 along the axial direction and is used for conveying the atomized smoking oil aerosol. Based on the usual design of the electronic cigarette product, the smoke passage 13 is connected to the air outlet 12 at the upper end and to an assembly of atomizer core 30 for producing the smoking oil aerosol at the lower end, so as to convey the smoking oil aerosol produced by the assembly of atomizer core 30 to a mouth piece for smoking by the smoker. Of course, the upper and lower ends of the smoke passage 13 may be connected to the air outlet 12 and the like in a directly or indirectly adapted manner. Meanwhile, an oil storage chamber 14 for storing smoking oil is formed in a hollow portion between the outer side wall of the smoke passage 13 and the inner side wall of the atomizer sleeve 10. Fibrous matters for storing the smoking oil or other materials with micropores are usually provided in the oil storage chamber 14, such as oil storage cotton and fibrous sponge body that are often used in the prior art.

Figure 5:
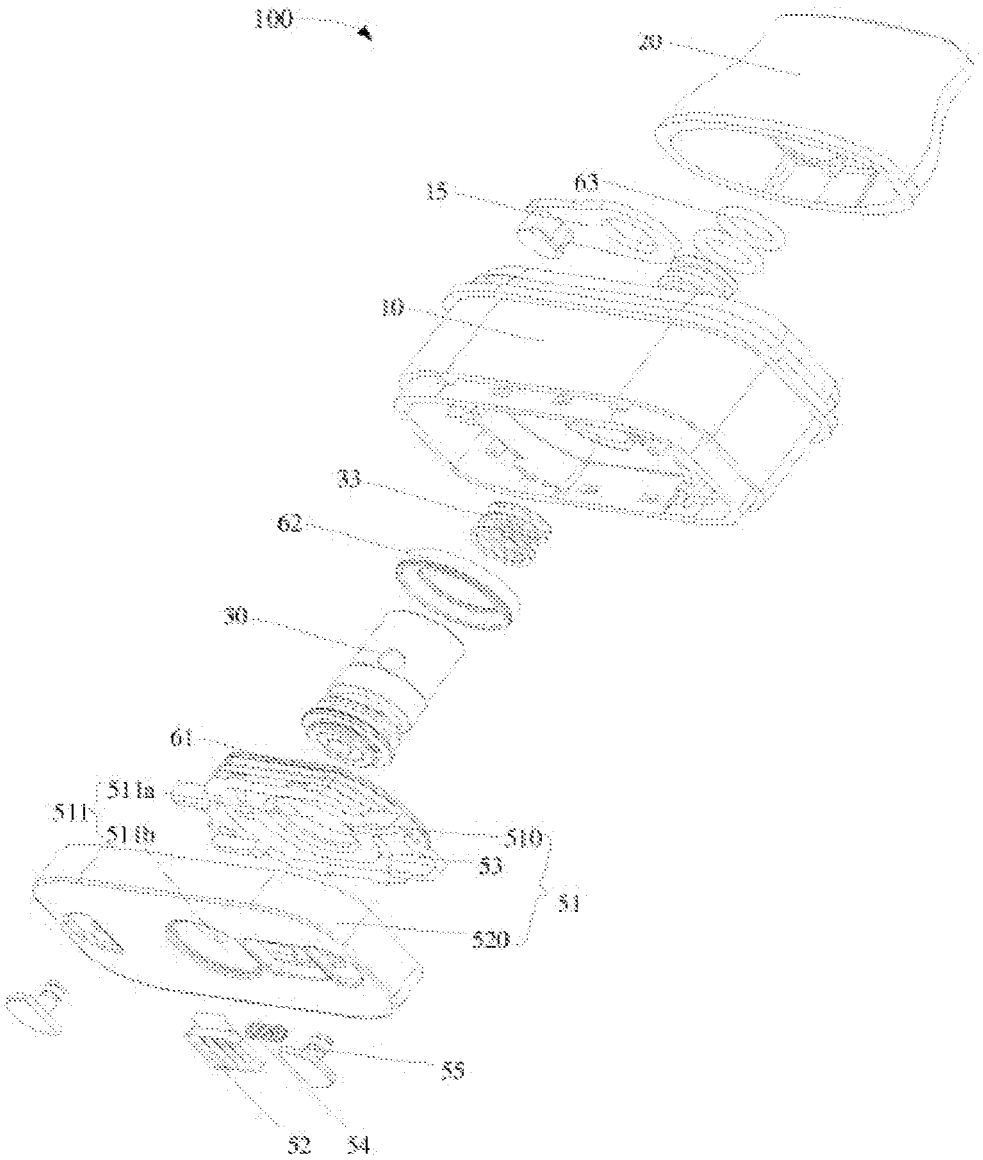
FIG. 5 is an exploded schematic structural diagram of an atomizer with a detachable atomizer core provided in the embodiments before assembling.

Further, an assembling structure of an atomization assembly mounted in the atomizer sleeve 10, detailed parts and the like can further refer to FIG. 4 and FIG. 5. FIG. 5 is an exploded schematic structural diagram of the atomizer 100 with a detachable atomizer core provided in the embodiments before the various portions are assembled. The axially disposed atomizer core 30 is mounted below the smoke passage 13 along the axial direction in the atomizer sleeve 10. In the drawing, the assembly of atomizer core 30 is a whole after the various components are assembled, and includes a hollow columnar porous body 31 for absorbing the smoking oil, and a heating wire 32 mounted on the inner surface of the hollow columnar porous body 31. The porous body 31 itself has a micropore structure and a micropore passage, so that it can absorb the smoking oil stored in the oil storage chamber 14 by means of capillary infiltration, and then convey the smoking oil to the heating wire 32 provided on the inner surface for heating and atomization to produce the aerosol. The produced aerosol is then conveyed from the smoke passage 13 to the mouth piece cap 20 for outputting and smoked by the smoker.

Specifically, in the above embodiment, the porous structure provided inside the porous body 31 is an open pore structure. During implementation, a porous ceramic body, a kieselguhr porous body, or a porous quartz glass body, and the like can be used. When the porous body 31 is used in the present disclosure, its outer surface is used as an oil absorption surface for absorbing the smoking oil, and its inner surface is used as an atomization surface for mounting the heating wire 32 for atomization. Micropores inside realize conveying of the smoking oil from the oil absorption surface to the atomization surface. It can also be seen from the schematic diagram of the section of FIG. 4, the structure of the heating wire 32 used in this embodiment is a wire and net combination. In addition to a filamentous heating portion, heating portions disposed into a grid are also embedded, so that the heating area and the heating uniformity are improved, and atomization of the smoking oil is more uniform.

It should be noted that the detachable atomizer core structure of the embodiment of the present disclosure can be applicable to various atomizers of similar structures, and is not limited to the type shown in the figure. The atomizer core 30 of the embodiment shown in figure is formed by providing the heating wire 32 on the inner surface of the hollow porous body 31. In other variant implementation modes, the atomizer core 30 may also be an external heating type formed by providing the heating wire 32 on the outer surface of the porous body 31, so that an oil guiding pipeline can be correspondingly provided on the atomizer sleeve 10 to guide the smoking oil in the oil storage chamber 14 to the porous body 31, and the smoking oil is atomized by the heating wire 32 provided on the outer surface.

Figure 6:
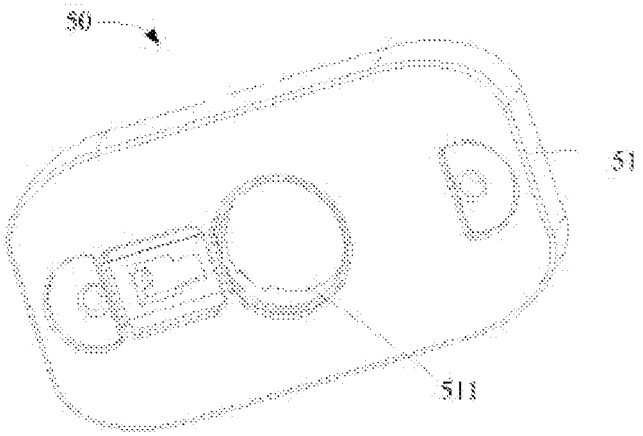
FIG. 6 is a schematic structural diagram of a base involved in the embodiment of FIG. 1.

Further referring to FIG. 4 to FIG. 6, in order to seal the oil storage chamber 14 to prevent the smoking oil from leaking and realize fixed assembling and detachability of the atomizer core 30. The lower end of the oil storage chamber 14 is provided with a sealing supporting assembly 50 along the axial direction of the atomizer sleeve 10. On one hand, the sealing supporting assembly 50 can seal the lower end of the oil storage chamber 14 to enable its inside to be a closed chamber to prevent leakage of the smoking oil; and on the other hand, the sealing supporting assembly can be used to support and fixing the detachable mounting of the atomizer core 30. Specifically, the sealing supporting assembly 50 includes a base 51. It should be noted that the base 51, in one aspect, is directed to facilitate subsequent mounting of the various functional components inside and the structural design such as opening of the atomizer. If the base 51 is designed into an inseparable whole, when the various functional components are mounted inside the base 51, it is significantly inconvenient for the removal operation. Therefore, in the optimal implementation mode shown in the figure, the base 51 is composed of a seat body 510 and a bottom cap 520. During subsequent assembling of the sealing supporting assembly 50, the bottom cap 520 is closed and locked after a part with a corresponding function is mounted on the seat body 510, so as to realize combination of the whole assembly. The assembled base 51 refers to FIG. 6. Compared with a method for designing the base 51 into a whole component and then perforating and slotting it to mount other components, the way that the seat body 510 and the bottom cap 520 form the base 51 is more convenient and faster. The various subsequent functional components are specifically mounted on either the seat body 510 or the bottom cap 520, which can be selected according to actual convenience. The embodiment in the figure is an optimal design carried out based on conditions of components. Connecting points of some components are disposed on the seat body 510, and connection points of some components are located on the bottom cap 520. However, in various other implementation modes, this design can be varied and optimized, and is not limited to the way that the components used in the embodiment shown in the figure are correspondingly mounted on either the seat body 510 or the bottom cap 520.

The appearance of the base 51 can be seen from the figure, which adopts a shape design adapting to the lower end of the atomizer sleeve 10. The center of the base 51 is provided with a through hole 511 opposite to the atomizer core 30; and based on the purpose of taking out the atomizer core 30 from the atomizer sleeve 10 for replacement and the common design knowledge, the size of the through hole 511 should be slightly greater than the sectional diameter of the atomizer core 30, so that the atomizer core 30 can penetrate through the through hole 511 and be taken out. Referring to FIG. 5, when the base 51 is composed of the seat body 510 and the bottom cap 520, the through hole 511 can also correspondingly include a first through hole portion 511*a* located on the seat body 510, and a second through hole portion 511*b* on the bottom cap 520; and the first through hole portion 511*a* and the second through hole portion 511*b* are oppositely disposed to jointly form the whole intact through hole 511.

Figure 7:
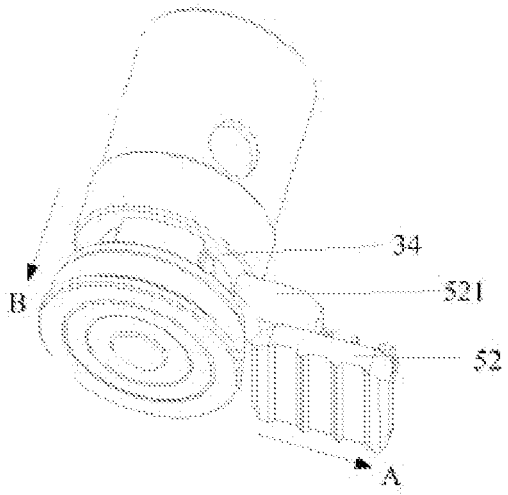
FIG. 7 is a schematic structural diagram of a locked state of a sliding latch and an atomizer core provided in the embodiments.
Figure 8:
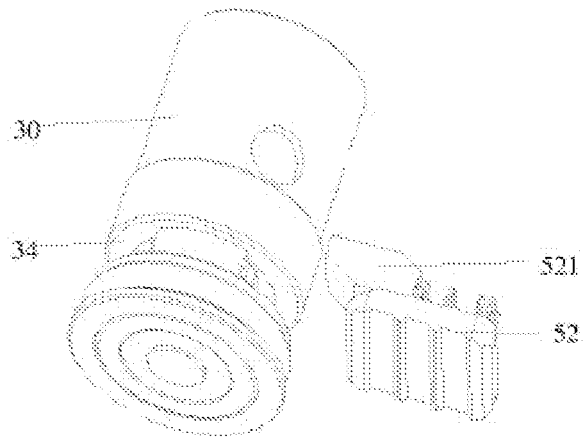
FIG. 8 is a schematic structural diagram of an unlocked state of the sliding latch and the atomizer core in the embodiment of FIG. 7.

Further referring to FIG. 4 and FIG. 5, in order to prevent the atomizer core 30 from automatically falling out of the through hole 511 when it does not need to be taken out, the sealing supporting assembly 50 further includes a sliding latch 52 arranged on the base 51. The sliding latch 52 is used for locking/unlocking the atomizer core 30, so that the atomizer core 30 is unlocked to be movably taken out when it needs to be taken out, and the atomizer core 30 is fastened in the atomizer sleeve 10 when it does not need to be taken out. Specifically, the sliding latch 52 is slidably mounted on the base 51, and the base 51 is correspondingly provided with two sliding positions along a sliding direction of the sliding latch 52. Specifically, combination states of the sliding latch 52 and the atomizer core 30 in the two positions are as shown in FIG. 7 and FIG. 8. FIG. 7 and FIG. 8 are respectively schematic structural diagrams of a locked state and an unlocked state of the sliding latch 52 and an atomizer core 30.

In FIG. 7, when the sliding latch 52 is in the first sliding position, the sliding latch 52 and the atomizer core 30 are locked and fixed to prevent the atomizer core 30 from axially falling out of the through hole 521, and the atomizer core 30 is fixed in the atomizer sleeve 10;

When it is necessary for unlocking, as shown in FIG. 7, the sliding latch 52 slides along the direction A to be separated from the atomizer core 30 as shown in FIG. 8. That is, when the siding latch 52 is in the second sliding position, the sliding latch 52 and the atomizer core 30 are unlocked and separated from each other, and the atomizer core 30 in a movable state can be taken out from the through hole 511 of the base 51 along the direction B shown in FIG. 7.

Figure 9:
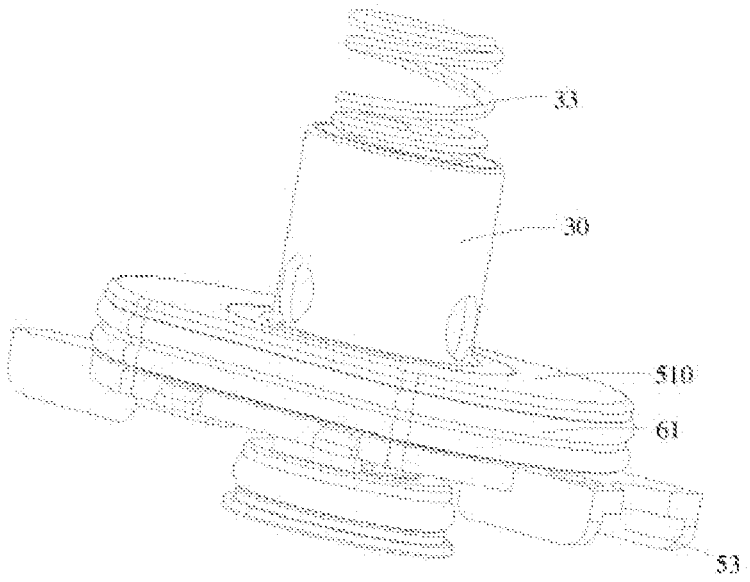
FIG. 9 is a schematic structural diagram of an atomizer core and a seat body provided in the embodiment after assembling.

Much further in the above implementation, in case of the above structures only, the atomizer core 30 can penetrate through the through hole 511 and be taken out, but it is relatively difficult to take out the atomizer core 30 without an external force when the atomizer core is removable. On one hand, the atomizer sleeve 10 needs to be downwards shook with a hand to pour the atomizer core 30 out of the atomizer sleeve 10, which is inconvenient to operate; and on the other hand, a large amount of the smoking oil attached on the atomizer core 30 and in the atomization chamber 14 will leak by the pour-out method, which is not sanitary and inconvenient to clean. Therefore, in order to enable the atomizer core 30 in an open state to be able to automatically fall out of the atomizer sleeve 10, the atomizer core 30 is additionally provided with a driving member 33. The driving member 33 is a linear spring in the optimal embodiments shown in FIG. 4, FIG. 5 and FIG. 9, i.e., a second linear spring. FIG. 9 is a schematic structural diagram of an atomizer core and a seat body provided in the embodiment after assembling. The driving member 33 is to apply an outward driving thrust from the inside to the atomizer core 30. The atomizer core 30 is pushed out of the inside from the through hole 511 after it becomes a movable state, thereby facilitating the replacement operation.

Of course, it can be seen from the sectional diagrams of FIG. 9 and FIG. 4 after the installation that the driving member 33 is mounted above the atomizer core 30 along the axial direction when it is the linear spring, with its lower end connected to the atomizer core 30 and its upper end fixedly connected to the inner wall of the atomizer sleeve 10. The sliding latch 52 and the atomizer core 30 are locked and fixed after the atomizer core 30 is normally mounted, and at this time, the driving member 33 is in a compressed state; and after the sliding latch 52 and the atomizer core 30 are unlocked, the driving member 33 is released from the compressed state to generate a thrust to push the atomizer core 30 out of the through hole 511 along the axial direction. In the above functional and structural design, the above linear spring is the most convenient implementation mode of the driving member 33. However, in other variant implementation modes, technical personnel can also replace it by, for example, an elastic damper or various push devices (a feasible electric push rod and the like) that can realize relevant functions, and a corresponding method is used for performing installation and implementation.

For connection during locking and fixing of the atomizer core 30 by the sliding latch 52, a relatively simple snap-in method is used in the present embodiment. Referring to FIG. 7 and FIG. 8, specifically, the sliding latch 52 is provided with a snap-in portion 521, and the atomizer core 30 is correspondingly provided with a snap-in opening 34 (the snap-in opening 34 can be either independently provided or adopt a slot formed between all the assemblies of the atomizer core during assembling); a sliding operation is performed on the sliding latch 52 to cause the snap-in portion 521 to snap in the snap-in opening 34, thereby realizing sliding locking; and when unlocking is needed, the snap-in portion 521 slides to be separated from the snap-in opening along the direction of the arrow A in FIG. 7 to realize an unlocking operation.

Figure 10:
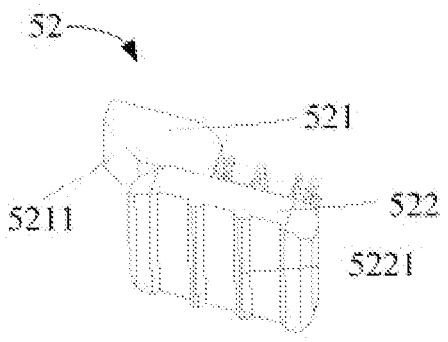
FIG. 10 is a schematic structural diagram of a sliding latch provided in the embodiments.
Figure 11:
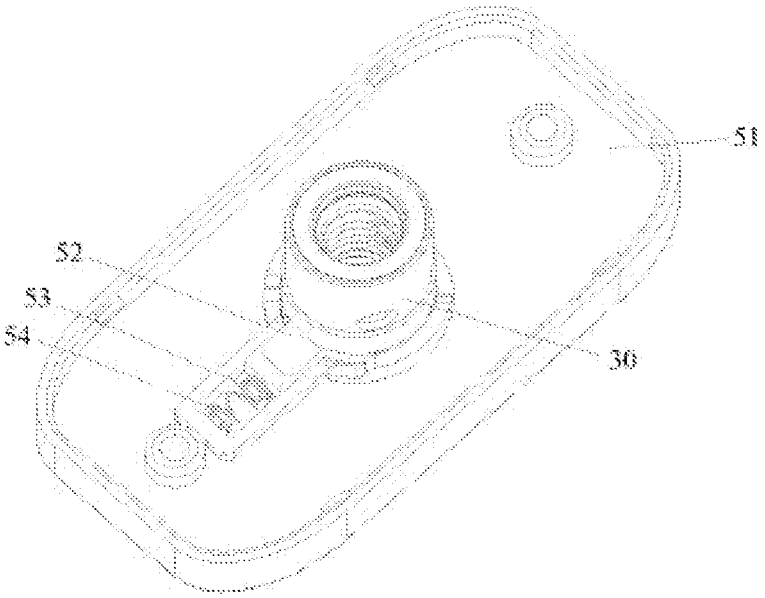
FIG. 11 is a schematic structural diagram of the atomizer core in the embodiment of FIG. 9 after it is assembled with a seat body and a bottom cap.

Further referring to FIG. 9 to FIG. 11, in implementation of the method for sliding unlocking of the sliding latch 52, in order to facilitate the sliding operation and the installation of the sliding latch 52, the base 51 is provided with a guiding groove 53, and the sliding latch 52 is then mounted in the guiding groove 53. On one hand, the guiding groove 53 can guide the sliding of the sliding latch 52 to make the sliding process smooth; and on the other hand, the guiding groove 53 can provide an assembling space for the sliding latch 52.

Based on the functional portions needing to be provided on the above sliding latch 52, in order to improve the convenience of installation and operation, the whole sliding latch can be designed into two portions, specifically as shown in FIG. 10. FIG. 10 is a schematic structural diagram of the sliding latch provided in the embodiment. The sliding latch 52 includes a sliding portion 522 and a snap-in portion 521. The sliding portion 522 is used to realize sliding fit with the guiding groove 53. Meanwhile, in order to facilitate a user to apply a force with a finger in the sliding operation, the sliding portion 522 has an anti-slip rough surface 5221 exposed outside the base 51. That is, the surface pressed by finger of the sliding portion 522 adopts the design of the anti-slip rough surface 5221, such as a concave-convex tooth surface in FIG. 10. Therefore, the operation that the user presses the rough surface for sliding with the finger can be smooth and stable. Of course, the surface pressed by finger is used to enable the user to press the sliding latch 52 with the finger to slide the sliding latch, so that the surface pressed by finger is exposed out of the base 51, which is convenient for finger contact and sliding pressing.

Further referring to FIG. 4, FIG. 5, FIG. 10 and FIG. 11, in order to enhance the handfeel of the sliding operation for the sliding latch 52 and also in order to prevent the problem that the sliding latch 52 is loosened in the first sliding position and the second sliding position, a sliding damping member 54 is also provided between the base 51 and the sliding latch 52. The sliding damping member 54 can be as shown in the figure in one implementation mode, i.e., a damping spring. It can also be seen from the figure that the damping spring is also a linear spring, i.e., a first linear spring that is disposed along a sliding direction and connected to the sliding latch 52 at one end and to the base 51 at the other end. A damping force is generated by means of an elastic force in the sliding process of the sliding latch 52. Of course, according to what is shown in FIG. 11, in order to facilitate the assembling, the sliding damping member 54 is mounted in the guiding groove 53 when it is the linear spring. Assembling along the sliding direction is convenient and stable. The sliding damping member can be installed according to an actual situation if other torsional springs, or dish elastic sheets, or other devices similar to the sliding damping member are used.

Figure 12:
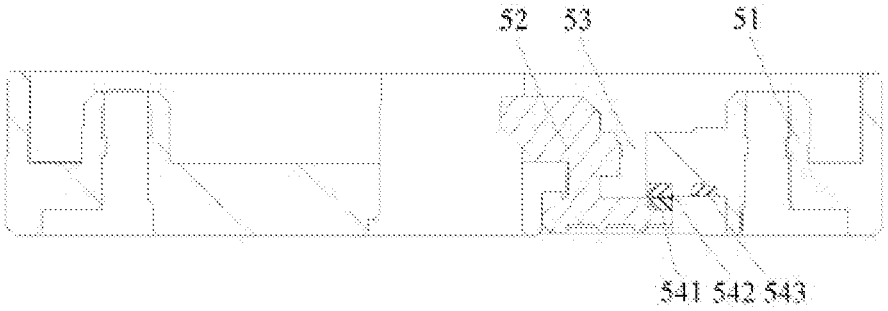
FIG. 12 is a schematic structural diagram of a sliding damping member provided in another embodiment.
Figure 13:
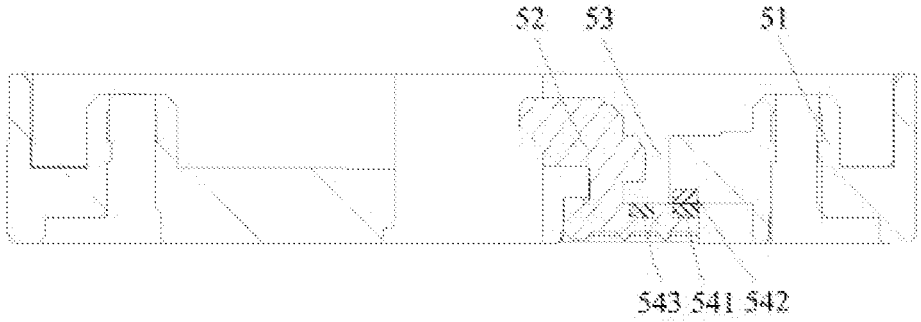
FIG. 13 is a schematic structural diagram of a sliding damping member provided in a further embodiment.
Figure 14:
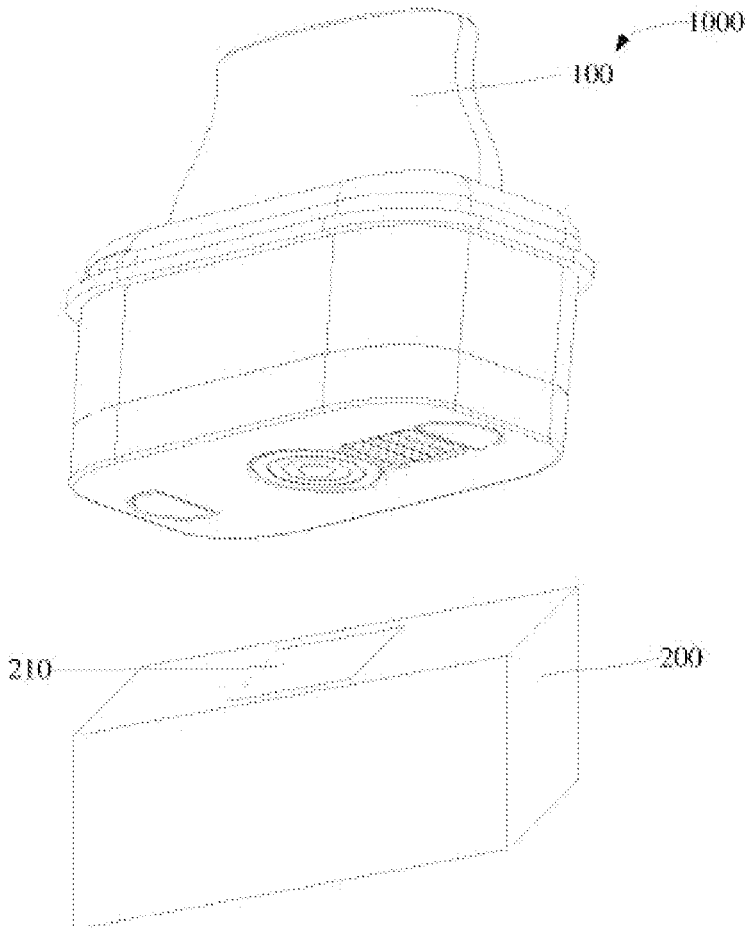
FIG. 14 is a schematic structural diagram of an electronic cigarette provided in the embodiments.

Referring to FIG. 12 and FIG. 13, FIG. 12 and FIG. 13 are respectively schematic structural diagrams of the sliding damping member in another two variant implementations. According to the accompanying drawings, the present disclosure further provides a sliding damping member 54 of another implementation mode. The sliding damping member 54 includes a first magnetic body 541 provided on the sliding latch 52, and a second magnetic body 542 provided on the base 51; and the second magnetic body 542 is magnetically connected to the first magnetic body 541 when the sliding latch 52 is in the first sliding position. Meanwhile, the sliding damping member 54 further includes a third magnetic body 543 that can be provided in the following two method, specifically:

- as shown in FIG. 12, the third magnetic body 543 is provided on the base 51. The third magnetic body 543 magnetically attracts the first magnetic body 541 when the sliding latch 52 is in the second sliding position;
- or, as shown in FIG. 13, the third magnetic body 543 is provided on the sliding latch 52. The third magnetic body 543 magnetically attracts the second magnetic body 542 when the sliding latch 52 is in the second sliding position.

If the above sliding damping member 54 with the three magnetic bodies, when the sliding latch 52 is respectively in the first sliding position and the second sliding position, the stability is maintained by magnetism, and the user can have a relatively good handfeel in the sliding process.

Much further referring to FIG. 10, a new atomizer core 30 needs to be plugged into the atomizer sleeve 10 from the through hole 511 along an opposite direction of the arrow B in FIG. 7, and snaps in the snap-in portion 521. In order to ensure the smoothness of the plugging process, the snap-in portion 521 is correspondingly provided with or correspondingly has a guiding slope 5211. The inclination direction of the guiding slope 5211 is slantways set along the snap-in sliding direction of the snap-in portion 521 towards the atomizer sleeve 10. When the new atomizer core 30 is plugged in from the outside of the through hole 511, guiding can be smooth; and when the plug-in depth makes the snap-in portion 521 snaps in the snap-in opening 34, snap-in is automatically realized for stable assembling. Meanwhile, the guiding slope 5211 should be located on a surface of the snap-in portion 521 opposite to the lower surface of the base 51 according to what is shown in the figure and functional descriptions, instead of being located on a surface opposite to the atomizer sleeve 10.

Further referring to FIG. 5, when an atomizer product is applied to an electronic flat cigarette product, the atomizer needs to be connected to a battery pack of the electronic cigarette at the lower end through axial assembling, so that the base 51 is further provided with a magnetic connector 55. (As shown in FIG. 4, there are two magnetic connectors 55). The magnetic connectors 55 have a plurality of functions in the embodiment of the present disclosure. One of the functions is to connect and lock the seat body 510 to the bottom cap 520, so that the seat body 510 and the bottom cap 520 are in fastened connection to form the base 51, thereby facilitating the assembling during connection of the atomizer to a power supply assembly of the electronic cigarette. Meanwhile, the locking is also favorable for improving the stability of the structure of the electronic cigarette. In another aspect, the magnetic connectors 55 can adopt magnets/or iron pillars and other materials. In this method, the magnetic connectors 55 can magnetically cooperate with and magnetically attract another structural member sequentially provided on the power supply assembly of the electronic cigarette, thereby facilitating installation on and aligning connection to the electronic cigarette.

Based on the above structures, the portions of the oil storage chamber 14 connected to all the other components may leak the smoking oil, so all the joints are provided with sealing members that respectively refer to FIG. 2, FIG. 5 and FIG. 9, specifically including a first sealing member 61 provided at the joint between the base 51 and the oil storage chamber 14, a second sealing member 62 provided between the atomizer core 30 and the base 51, and a third sealing member 63 provided between the air outlet 11 of the atomizer sleeve 10 and the mouth piece cap 20.

Referring to FIG. 2 at the same time, in order to facilitate supplementing smoking oil to the atomization chamber 14; the upper end of the atomization chamber 14 is provided with an oil injection opening for adding smoking oil (in FIG. 2, the oil injection opening has been covered by a patch 15, so that it is not marked independently), and the patch 15 for opening and closing the oil injection opening at the surface opposite to the mouth piece cap 20. In order to facilitate the assembling and oil injection operations, the patch 15 is provided with a taphole 151 corresponding to the oil injection opening. The taphole is opened if oil injection is necessary; and the taphole 151 is closed if oil injection is not necessary.

By the adoption of the above atomizer structure with the detachable atomizer core of the present disclosure, the atomizer core is locked and unlocked by means of sliding of the sliding latch, so that replacement of the atomizer core is realized in combination with the through hole in the base through a down core replacement method, without affecting variations of other components. This structure is simple, fast and sanitary, and does not leak oil.

Based on the above atomizer 100 with the detachable atomizer core, the embodiment of the present disclosure further provides an electronic cigarette 1000. The above atomizer 100 with the detachable atomizer core can be combined with a power supply assembly 210, a control circuit and the like of the electronic cigarette 1000 to form a complete electronic cigarette product, wherein the power supply assembly 210 is used for supplying power to the atomizer.

By the adoption of the electronic cigarette product including the above atomizer with the detachable atomizer core of the present invention, by means of the design of down air intake and down replacement of the atomizer core, during replacement of the atomizer core, the smoking oil cannot flow out, and the atomizer core can automatically pop out through sliding of the sliding latch; during mounting of the atomizer core, the atomizer core is plugged according to the direction, so that the operation is simple; and the atomizer is sanitary and free of oil leakage.

The above embodiments are only partial implementation modes exemplified by this specification to facilitate understanding of the invention content, do not make any limitations to the technical solutions of the present disclosure, and are not an exhaustive list of all possible solutions, so any small improvements or equivalent replacements that is made for the structure, flow or steps of the present disclosure shall all fall within the protection scope of the present disclosure.

What is claimed is:

1. An atomizer with a detachable atomizer core, comprising a hollow atomizer sleeve with an open end, said atomizer sleeve comprising an oil storage chamber for storing smoking oil, said atomizer further comprises the atomizer core for atomizing the smoking oil; wherein said atomizer further comprises a base arranged at the open end of the atomizer sleeve; said base is provided with a through-hole for the atomizer core to penetrate to insert inside said atomizer sleeve, and a sliding latch slidingly connected to the base;

said base is further provided with a first sliding position and a second sliding position along the sliding direction of the sliding latch, wherein said sliding latch is configured such that when said sliding latch is in the first sliding position, said sliding latch is connected to the atomizer core to restrict axial movement of said atomizer core along said through-hole when said sliding latch is in the second sliding position, said sliding latch and the atomizer core are disengaged from each other to release said restriction.

2. The atomizer with detachable atomizer core as claimed in claim 1, wherein a sliding damping member is provided between said sliding latch and the base for providing damping during the sliding of said sliding latch.

3. The atomizer with detachable atomizer core as claimed in claim 2, wherein said sliding damping member is a first linear spring provided along the sliding direction of the sliding latch; the first linear spring is connected to the sliding latch at one end and to the base at the other end.

4. The atomizer with detachable atomizer core as claimed in claim 2, wherein said sliding damping member comprises:

a first magnetic body provided on the sliding latch;

a second magnetic body provided on the base for attracting the first magnetic body when the sliding latch is in the first sliding position; and a third magnetic body either provided on the sliding latch for attracting said second magnetic body when the sliding latch is in a second sliding position, or provided on the base for attracting said first magnetic body when the sliding latch is in a second sliding position.

5. The atomizer with detachable atomizer core as claimed in claim 1, wherein said sliding latch comprises a sliding portion for effecting a sliding connection with the base, and a snap-in portion for effecting a snap-in connection with the atomizer core;

said atomizer core is provided with a snap-in opening adapted to the snap-in portion; and when said sliding latch is in the first sliding position, said sliding latch is fixedly connected to the atomizer core by means of the snap-in portion and the snap-in opening.

6. The atomizer with detachable atomizer core as claimed in claim 5, wherein said snap-fit portion is provided with a guiding slope on a surface opposite to the atomizer core; the guiding slope is provided in the direction of the sliding snap of the sliding latch, and in the direction of the atomizer sleeve at an angle.

7. The atomizer with detachable atomizer core as claimed in claim 5, wherein said base is provided with a guiding groove arranged along the sliding direction of the sliding latch, said sliding portion slidably arranged in the guiding groove.

8. The atomizer with detachable atomizer core as claimed in claim 5, wherein said sliding portion has an anti-slip rough surface exposed outside the base.

9. The atomizer with detachable atomizer core as claimed in claim 1, wherein said atomizer sleeve is further provided with a driving member for driving the atomizer core through the through hole to the outside.

10. The atomizer with detachable atomizer core as claimed in claim 9, wherein said driving member is a second linear spring provided in the direction of the atomizer core through the through hole, one end of the second linear spring being connected to the inner wall of the atomizer sleeve while the other end connected to the atomizer core.

11. The atomizer with detachable atomizer core as claimed in claim 1, wherein a first sealing member is provided between said base and the oil storage chamber; and/or a second sealing member is provided between said atomizer core and the base.

12. The atomizer with detachable atomizer core as claimed in dam 1 wherein said base is further provided with a magnetic connector.

13. An electronic cigarette comprising an atomization device and a power supply device assembled with each other, the power supply device comprising a power supply assembly for supplying power to said atomization device, wherein said atomization device is the atomizer with detachable atomizer core as claimed in claim 1.

* * * * *